United States Patent [19]

Roerig et al.

[11] Patent Number: 4,949,475

[45] Date of Patent: Aug. 21, 1990

[54] TEMPERATURE COMPENSATED VENTILATING ROLL

[75] Inventors: Arnold J. Roerig; Gregory L. Wedel, both of Beloit; Dale A. Brown, Milton, all of Wis.

[73] Assignee: Beloit Corporation, Beloit, Wis.

[21] Appl. No.: 453,516

[22] Filed: Dec. 20, 1989

[51] Int. Cl.[5] ..... F26B 13/16

[52] U.S. Cl. ..... 34/115; 34/117; 34/122

[58] Field of Search ..... 34/115, 116, 117, 119, 34/122; 162/368, 370; 29/110, 121.1

[56] References Cited

U.S. PATENT DOCUMENTS

| | | | |
|---|---|---|---|
| 3,304,626 | 2/1967 | Leckner | 34/122 |
| 3,345,757 | 10/1967 | Daane | 34/111 |
| 3,702,503 | 11/1972 | Nichols | 34/114 |
| 4,252,184 | 2/1981 | Appel | 34/119 |
| 4,485,567 | 12/1984 | Ely | 34/115 |
| 4,492,044 | 1/1985 | Knutsen | 34/114 |
| 4,882,854 | 11/1989 | Wedel et al. | 34/115 |

*Primary Examiner*—Henry A. Bennet
*Assistant Examiner*—Denise L. Ferensic
*Attorney, Agent, or Firm*—Dirk J. Veneman; Raymond W. Campbell; Gerald A. Mathews

[57] ABSTRACT

A ventilating roll for introducing a supply of relatively dry air into the pocket spaces between dryer rolls and the co-running fabrics and paper web in a papermaking machine, and removing the relatively moist air which is liberated from the traveling paper web as it comes into contact with the heated dryer rolls. The ventilating roll has a plurality of separate compartments, some of which conduct super-atmospheric pressure air into the pocket spaces, and some of which conduct sub-atmospheric air out of the pocket spaces. The compartments conducting air into the roll alternate with the compartments for conducting air out of the roll. The temperature of the internal structure of the roll is thereby balanced circumferentially about the center shaft of the roll and thermal bowing of the roll is kept to a minimum.

16 Claims, 5 Drawing Sheets

TEMPERATURE COMPENSATED VENTILATING ROLL

BACKGROUND OF THE INVENTION:

This invention relates to the ventilation of the so-called pockets in the dryer section of a papermaking machine. More specifically, the invention relates to a type of roll, commonly referred to as a "pocket-ventilating roll" in the papermaking industry, which removes moist air from the dryer section and replaces it with relatively dry air. Still more particularly, the invention relates to a unique design for a pocket ventilating roll which has a plurality of separate, longitudinally extending chambers for alternately conducting moist air and dry air, and which moist air and dry air might travel in opposite directions during at least a portion of their route of travel.

In the dryer section of a papermaking machine, a large number of dryer rolls are arranged in one or more tiers and the traveling paper web to be dried is wrapped around the peripheries of the dryer rolls to be heated to drive moisture from the web. A felt or fabric is utilized to cover the paper web over its outer surface while pressing the inner surface of the web against the surface of a dryer roll to optimize the drying process.

Between the heated dryer rolls are a plurality of so-called felt, or turning, rolls over which the dryer felt, or felts, are directed to maintain the paper web in contact with the preceding dryer roll as long as possible, and to bring the web into contact with the next dryer roll. These felt turning rolls can be the pocket ventilating rolls of this invention.

The spaces between dryer rolls and the traveling web and dryer felts are known as pockets, or pocket spaces. During the operation of the dryer section in the papermaking machine, the air in the pockets in the center of the papermaking machine, that is to say inwardly from each side of the machine, becomes very moist with the water driven out of the heated paper web. The air nearest the ends of the rotating dryer rolls migrates out of the pockets and is replaced by somewhat less moist air by convection, but the moist air in the pockets in the center of the machine tends to be trapped there. This inhibits the web drying process.

The difference in the moisture content of the air in the middle of the machine transversely of the web compared with the moisture content of the air near either end of the rolls tends to produce a web at the reel having relatively dry edges with a relatively moist center area. This, of course, is deleterious to the overall quality of the paper product produced.

Prior pocket ventilating rolls attempted to alleviate this problem by directing relatively dry air inwardly longitudinally along one side of the hollow core body of the roll inwardly to be dispersed in the pocket while simultaneously urging moist air into the roll on the other side of the hollow core for removal through one end of the roll. Such a roll operates somewhat satisfactorily, but there are problems associated with the thermal bowing of the hollow, internal, stationary core body, or center shaft, of the roll due to temperature differentials caused by the differences in temperature of the air being conveyed into the roll and the air being conveyed out of the roll. These problems cause seal leakage, excessive seal wear, vibration of the roll and require special handling to equalize temperature along the length of the roll during start-up procedures.

SUMMARY OF THE INVENTION:

This invention alleviates the problems associated with thermal bowing of prior types of pocket ventilating roll center shafts. In this invention, the roll is comprised of a plurality of longitudinally extending duct-like conduits and chambers. In a preferred embodiment, the inner space of the cylindrical center shaft of the roll is divided into four such chambers having equal cross-sectional areas. The chambers are defined by radially extending walls within the core body (center shaft). Adjacent chambers are connected to a source of super-atmospheric air pressure and a source of sub-atmospheric air pressure. These are pressure and vacuum chambers, respectively. At least one of the pressure and one of the vacuum chambers are perforated and thereby linked with the pockets via the perforated roll shell. Longitudinally extending seals between the core body, or center shaft, and roll shell maintain fluid separation between the perforated pressure and vacuum chambers.

In addition, the two pressurized chambers are interconnected at the end of the roll as are the two vacuum pressure chambers. This permits pressurized air to travel inwardly in one direction along the longitudinal length of the roll and outwardly in the opposite chamber. Similarly, vacuum pressure air travels inwardly in one direction and outwardly in the opposite direction along the longitudinal length of the roll. This arrangement permits both relatively hot, dry pressurized air to be interspaced between the relatively warm, moist air while both types of air travel in either direction along the length of the pocket ventilating roll. The thermal forces acting to expand and contract the metal in the core body of the roll thus operate to neutralize each other axially and circumferentially about the roll body, and the core body remains essentially straight for its entire length. This reduces wear on the seals due to diminished radial deformation of the core body relative to the outer rotational roll shell. This promotes more reliable sealing of the chambers and longer seal life. It also provides for more uniform contact of the seals against the rotating inner surface of the roll shell, and this lessens the likelihood of vibration in the roll during operation.

Accordingly, it is an object of this invention to provide a more reliable pocket ventilating roll.

Another object of this invention is to provide a pocket ventilating roll having diminished thermal distortion of its hollow center shaft during operation.

An advantage of this invention is that the pocket ventilating roll has seals having longer useful life.

Another advantage of this invention is the provision of a pocket ventilating roll which does not require any special start-up procedures to perform as intended.

These, and other objects, features and advantages of the invention will become more readily apparent to the artisan upon reading the following description of the preferred embodiments in conjunction with the attached drawings.

DESCRIPTION OF THE PREFERRED EMBODIMENTS:

In describing this invention in conjunction with the prior art design of a pocket ventilating roll, corresponding components will be correspondingly designated numerically with alphabetical subscripts used to distinguish between them, and with a prime notation used to distinguish between similar elements on the same structure.

Figure 1:
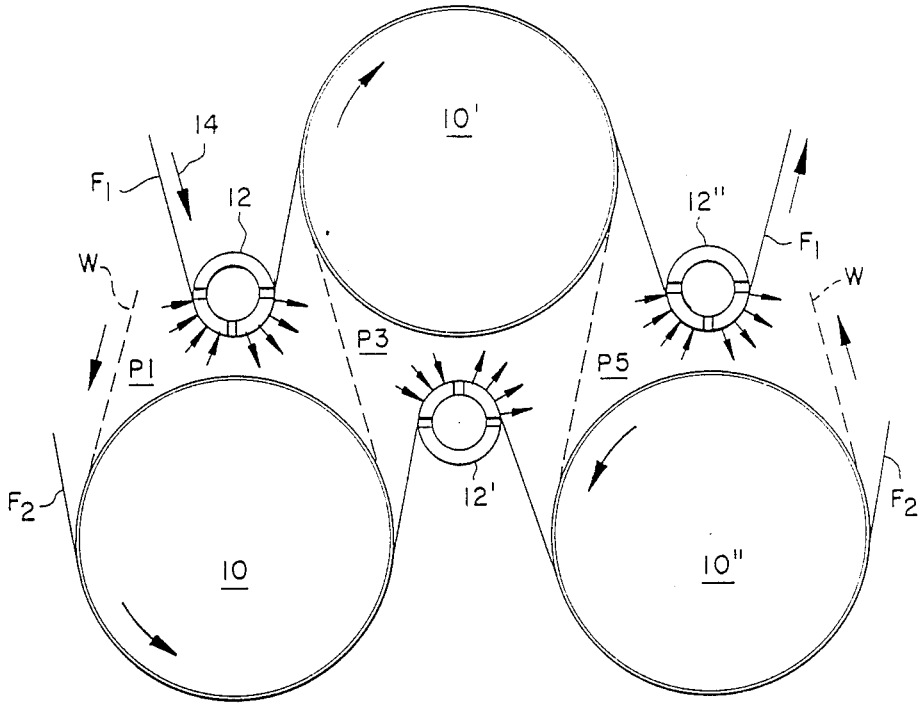
FIG. 1 is a side-elevational view of a portion of a typical dryer section in a papermaking machine showing the dryer rolls arranged in two tiers with intermediate pocket ventilating rolls.

As shown in FIG. 1, a somewhat schematic side-elevational view of a dryer section in a papermaking machine has two tiers of dryer rolls 10. An upper felt Fl traveling in the direction of arrow 14 is shown being turned over the surface of a rotating pocket ventilating roll 12 and then guided into contact with the co-traveling paper web W, which is guided onto the surface of upper dryer roll 10′ beneath the felt Fl. Similarly, a lower felt F2 is guided to hold the web W on the surface of a lower dryer roll 10 and is then turned over the surface of a rotating lower pocket ventilating roll 12′ and then onto the next successive dryer roll 10″ in the lower tier over the web W.

Thus, the web alternates in traveling over the surface of dryer rolls in the lower and upper tiers of dryers while the felts F1 and F2 are disposed to remain in their respective upper and lower tiers by being turned over corresponding pocket ventilating rolls in the upper and lower tiers.

The spaces between the uncovered surfaces of the dryer rolls, the web and the felts, designated P1, P3 and P5 are called pockets. These pockets extend transversely of the dryer section of the papermaking machine parallel to the longitudinal length of the rolls 10,12.

During the drying process, moisture expressed from the paper web W during its contact with the heated surface of the dryer rolls 10 builds up in these pockets because it cannot escape upwardly or downwardly due to its confinement by the dryer rolls, paper web and felts. Consequently, unless it is removed by some means, such as a pocket ventilating roll, the moisture escapes only slowly as it migrates laterally in the direction of the width of the papermaking machine.

Figure 2:
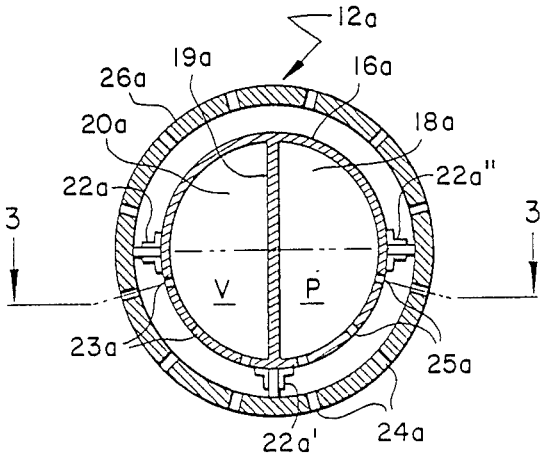
FIG. 2 (PRIOR ART)
FIG. 2 is an end-elevational view, in section, of a prior art type of pocket ventilating roll having two chambers in its inner body.
Figure 3:
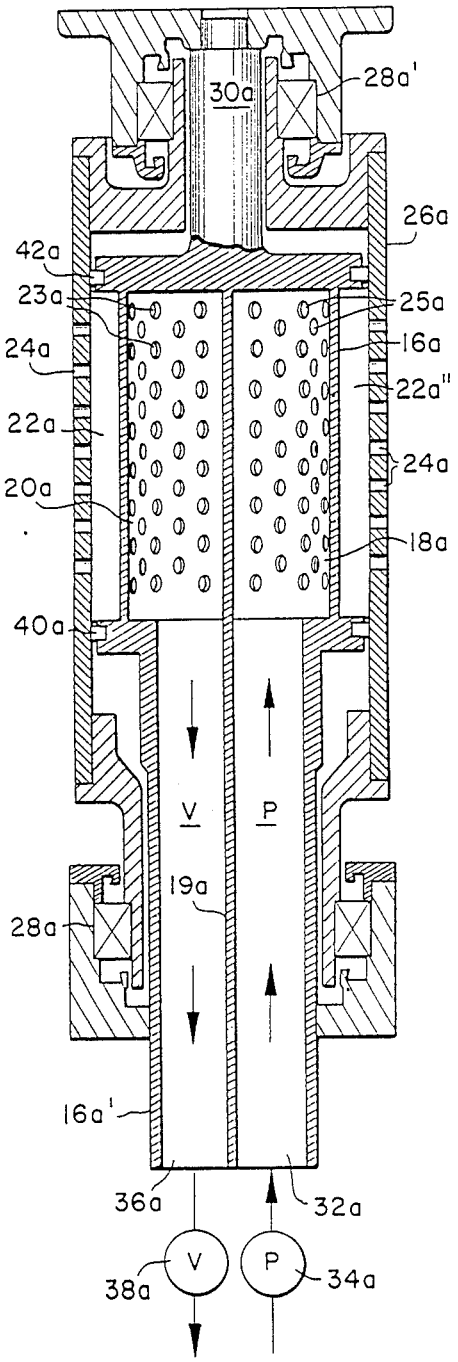
FIG. 3 (PRIOR ART)
FIG. 3 is a plan view of the roll shown in FIG. 2 along section 3—3.

With reference to FIGS. 2 and 3, the typical prior art pocket ventilating type of roll comprises a central core body 16*a* having a longitudinally extending wall 19*a* which divides the core body into two chambers 18*a*,20*a*. These chambers, and the core body, extend for the effective operational length of the roll which essentially is the width of the roll face, shell 26*a* between circumferential end seals. The rotatable roll shell 26*a* having a plurality of perforations 24*a* is rotatably mounted on bearings 28*a*,28*a*′ at either end with respect to the core body which has a journal 30*a* at its far end.

A duct-like conduit 32*a* is connected to a source of super-atmospheric pressurized air, such as an air fan 34*a*, and is accordingly designated P. Similarly, conduit 36*a* is connected to a source of sub-atmospheric pressure, such as vacuum pump 38*a*, and is designated with a V. Conduits 32*a*,36*a* form a necked-down, hollow front end journal 16*a*′ extension of core body 16*a* and are in fluid communication with chambers 18*a*,20*a*, respectively.

Seals 22*a*, 22*a*′ and 22*a*″ define an arcuate segment of vacuum and pressure chambers 20*a*,18*a*, respectively. A plurality of openings 23*a*,25*a*, which may be perforations, are formed in the vacuum and pressure chambers, respectively. These seals slidably engage the inner surface of the roll shell and permit the sub-atmospheric pressure air and super-atmospheric pressure air in chambers 20*a*,18*a* to communicate with the pocket spaces P1–P5 via the perforations 24*a* in the roll shell as shown by the arrows.

The pocket ventilating rolls 12*a* of the prior-art type shown in FIGS. 2 and 3 promoted removal of the moisture-laden air, and replacement with air having less moisture, by introducing fresh, pressurized air P into the right chamber 18*a* of the bifurcated core body 16*a*, and removing the moisture-laden air under vacuum pressure V along the left chamber 20*a*. A central diametrical wall 19*a* separates the two chambers. This arrangement operates satisfactorily, but the relatively moist air in chamber 20*a*, which is driven from the paper web held against the hot dryer roll surface, is cooler than the relatively less moisture-laden fresh hot air being introduced under pressure P in chamber 18*a*. Over time, with reference to FIGS. 2 and 3, this thermal imbalance causes the right chamber 18*a* to expand and push its seal 22a" against the rotating roll shell with more force than opposed seal 22a which, being mounted over the vacuum air chamber 20a, is cooler and therefore not subject to the expansionary forces of the same magnitude as the seal over the warmer pressure chamber 18a.

Figure 4:
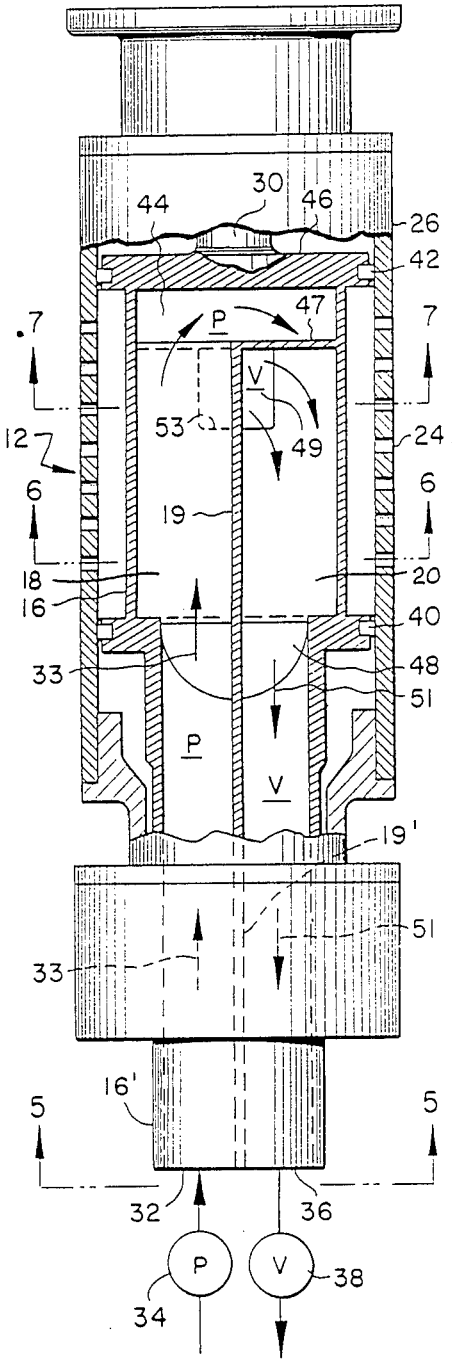
FIG. 4 is a plan view of the pocket ventilating roll of this invention wherein the upper portion of the middle part of the roll has been broken away to better illustrate the internal parts of the roll which are partially shown in section.
Figure 5:
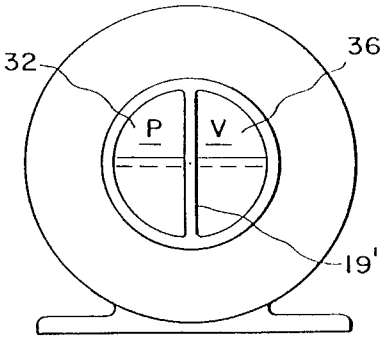
FIG. 5 is an end-elevational view along lines 5—5 of the roll shown in FIG. 4.

Referring to the invention shown in FIGS. 4–8, pressurized air supplied by air fan, or pump, 34 is introduced into conduit 32 which has a cross-sectional shape in the form of a semi-circular segment as shown in FIG. 5. At a point between the ends of the effective face length of the roll, which extends essentially between the circular seals 40,42 beneath the perforated portion of the roll shell, the roll body 16 is divided into longitudinally extending 90° segment shaped chambers 18,18',20,20' by mutually perpendicular, diametrically extending, walls 19,21 which intersect at the center of the roll.

Figure 8:
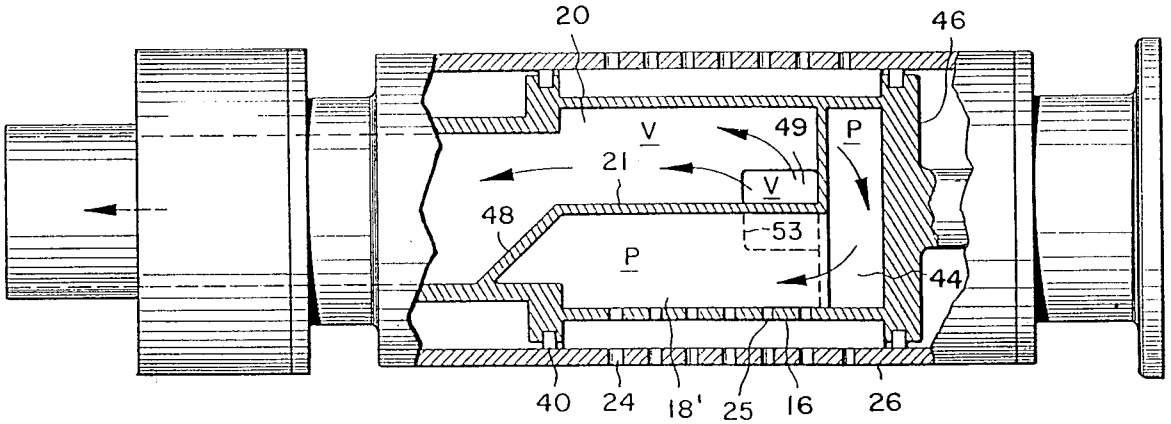
FIG. 8 is a plan view along section 8—8 of the roll shown in FIG. 6.

As shown more clearly in FIG. 8, the semi-circular cross-sectional shaped conduits 32,36 make a transition into quarter-circular cross-sectional shaped chambers 18,20 near where the effective length of the roll surface begins over the front end circumferential seal 40. This is done with a slanted wall 48 which terminates the ends of lower chambers 18',20'.

Figure 6:
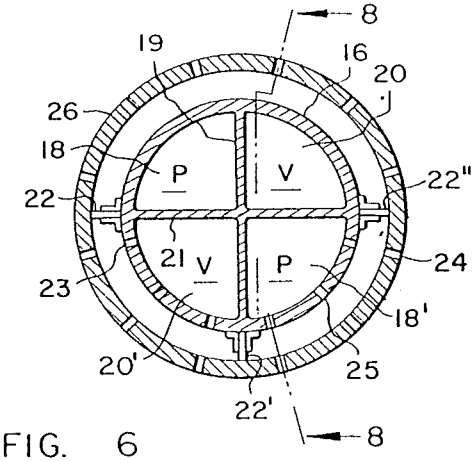
FIG. 6 is an end-elevational view, in full section, along lines 6—6 of the complete roll shown in FIG. 4.
Figure 7:
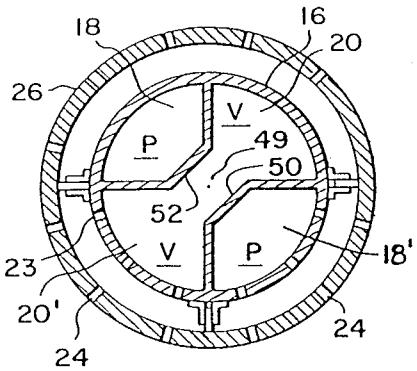
FIG. 7 is an end-elevational view, in full section, along line 7—7 of the complete roll shown in FIG. 4.

As shown in FIG. 6, the upper chambers 18,20 of the air distribution center shaft, or core body 16, are completely enclosed and serve to convey super-atmospheric pressure air P into the roll through chamber 18 and remove sub-atmospheric air from the roll through chamber 20. This will be subsequently explained in more detail.

Near the far end of the roll, and near the end of the effective face length of the roll, pressurized air P in chamber 18 is directed into an end chamber 44 which, in turn, redirects the air into chamber 18'. This effectively reverses the flow of pressurized air so that air which enters the roll in one direction through conduit 32 and into chamber 18, as indicated by arrow 33 in FIG. 4, is redirected in the reverse direction and back through chamber 18'. The far end of chamber 44 connecting chambers 18,18' is closed by wall 46. Chambers 18',20' are separated at the forward end of the effective length of the roll by a slanted wall 48. This forces the pressurized air, to be distributed into the pockets, outwardly through perforations 25 in chamber 18' and the perforations 24 in the roll shell.

Similarly, with reference to FIGS. 4, 5, 6 and 7, air vacuum fan 38 induces a sub-atmospheric air pressure V in conduit 36 which is connected to enclosed chamber 20. Near the far end of the roll, an opening 49 created by walls 50,52 links enclosed chamber 20 with perforated chamber 20'. Thus, the sub-atmospheric air pressure in conduit 36 induces moisture-laden air to enter chamber 20' through the perforations 24 in the roll shell and perforations 23 in the chamber 20' to travel back along chamber 20', through opening 49 and forwardly, with reference to arrow 51 in FIG. 4, in chamber 20 and out of the roll through conduit 36.

As shown in FIGS. 4 and 5, conduits 32,36 are defined by a diametral wall 19' and a cylindrical journal 16'. The journal 16' is a smaller diameter extension of core body 16 on the front end of the roll and is concentric with core body 16. Similarly, diametral wall 19' is an axial extension through journal 16' of diametral wall 19.

It is pointed out that chamber 44, which is bounded by the cylindrical wall of core body 16, end wall 46 and intermediate wall 47, is in complete fluid isolation from opening 49, which is bounded by walls 47,50,52,53. Thus, super-atmospheric pressure P chambers 18,18' and chamber 44 are in complete fluid separation from sub-atmospheric pressure V chambers 20,20' and opening 49.

In operation, therefore, with reference to FIGS. 4-8, pressurized air from outside the roll, which contains relatively less moisture than the air in the pockets, is introduced from an air fan, or pump, 34 into conduit 32 and into enclosed upstream chamber 18 in the direction of arrow 33 to the rear end of a roll from the forward end. The pressurized air then enters chamber 44 where it's direction is reversed and it is directed towards the front end of the roll into downstream chamber 18' from which it is discharged outwardly through openings 25 in the core body 16 and through the perforations 24 in the roll shell and into the pocket spaces P1,P3,P5.

In a similar manner, sub-atmospheric pressure air V is withdrawn by vacuum pump 38 to conduit 36 which is in fluid communication with enclosed chamber 20. This vacuum pressure induces relatively moist air from the pockets P1,P3,P5 into upstream vacuum chamber 20' via perforations 24 in the roll shell and openings 23 in the core body 16. This moist air travels toward the rear of the core body, through opening 49 and in the reverse direction through enclosed downstream chamber 20 towards the front end of the shell, as shown by arrow 51 in FIG. 4, and out of the roll through conduit 36.

Accordingly, it is seen that the flow of relatively moist, warm air from the pocket spaces is induced rearwardly in chamber 20' and forwardly in diametrically opposite chamber 20. Similarly, relatively dry, hot air from outside the dryer section is induced to flow rearwardly in chamber 18, which is circumferentially between chambers 20' and 20. The pressurized, relatively dry, hot air is then directed forwardly in chamber 18' which is circumferentially between chambers 20,20' and diametrically opposite chamber 18.

The relatively hot and warm flows of air are thus seen to be in opposite directions longitudinally of the roll, and in the adjacent chambers circumferentially about the core body. This operates to equalize the temperature of the core body in both the longitudinal and circumferential directions with the attendant advantage of diminishing thermal deformation of the core body. The seals 22,22" opposite either end of laterally extending diametrical wall 21 are thus more equally affected by the forces of thermal expansion because they are more equally exposed to the same temperatures. The same applies to the thermal forces affecting seal 22' disposed over the lower end of diametral center wall 19.

Figure 11A:
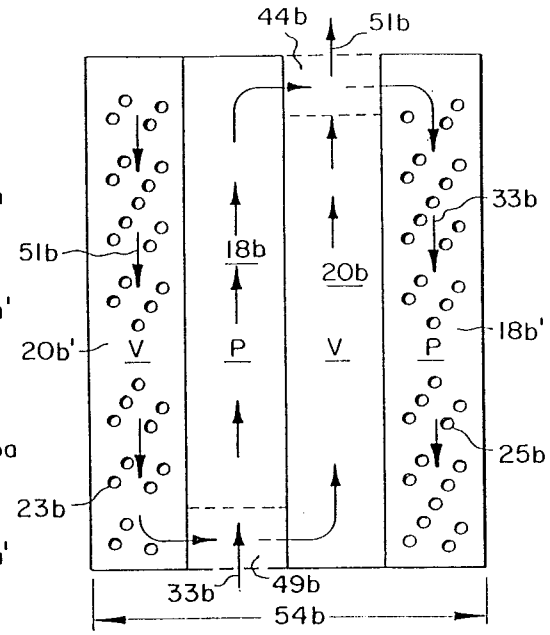
FIGS. 11 and 11*a* are end elevational and development views of the roll shaft (core body) and its circumference, respectively, and showing the application of super-atmospheric and sub-atmospheric air pressure P,V, respectively, to one of each of such chambers from both ends of the core body.
Figure 11:
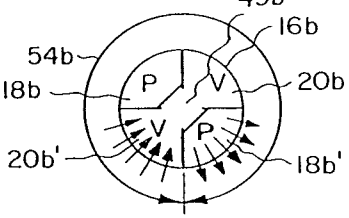

FIGS. 9,9a, 10,10a, 11,11a, 12,12a, and 13,13a are schematic views showing other embodiments of this invention wherein the application of super-atmospheric air pressure and sub-atmospheric air pressure is applied to one of the super-atmospheric and one of the sub-atmospheric pressure chambers from one end of the roll (FIGS. 9,9a) or to one super-atmospheric pressure chamber at one end of the roll and one sub-atmospheric air pressure chamber at the other end of the roll (FIGS. 11,11a).

In all of the configurations shown in FIGS. 9–13, the apparatus has been simplified for purposes of clarity. Accordingly, such items as the roll journals, bearings, roll shell, air pump (fan), vacuum pump and the various seals, all of which are shown in one or more of the other figures and which are described above in the specification, have been omitted from these figures. Their function and operation is the same as their counterparts in the embodiments shown in FIGS. 4–8.

Figure 10A:
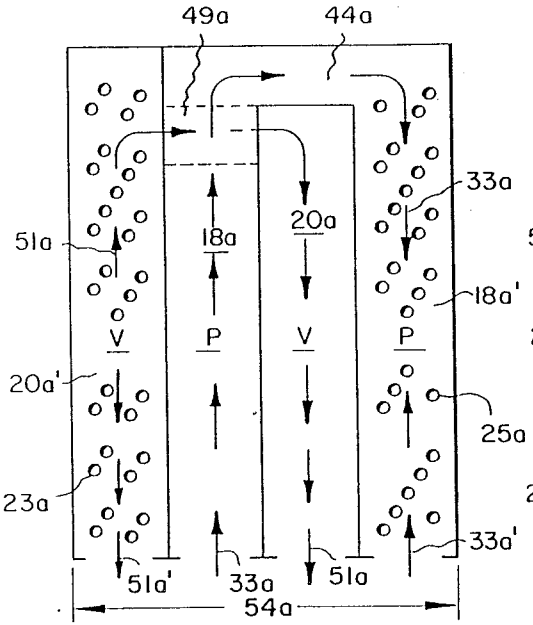
FIGS. 10 and 10*a* are end elevational and development views of the roll shaft (core body) and its circumference, respectively, and showing the application of super-atmospheric and sub-atmospheric air pressure P,V, respectively, to two of each of such chambers.
Figure 10:
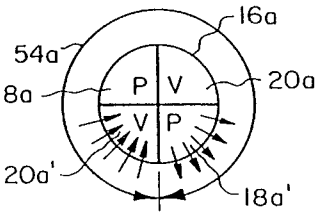
Figure 9A:
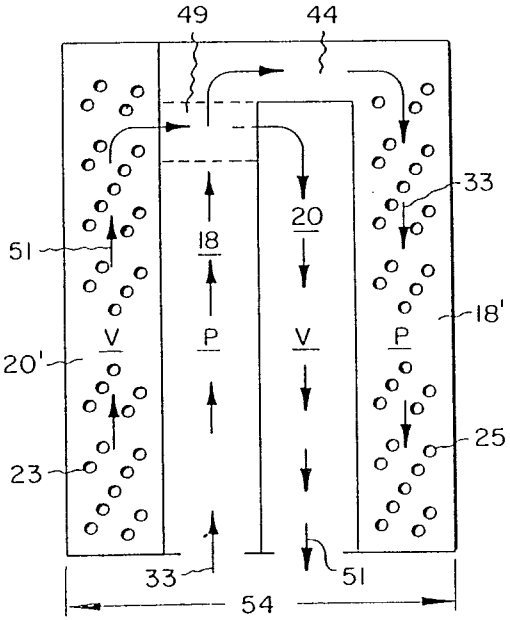
FIGS. 9 and 9*a* are end elevational and development views of the roll shaft (core body) and its circumference, respectively, and showing the application of super-atmospheric and sub-atmospheric air pressure P,V, respectively, to one of each of such chambers.
Figure 9:
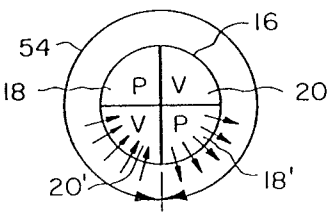

In FIGS. 10,10*a*, super-atmospheric air pressure is applied to each of two chambers 18*a*,18*a*′ at one end of the roll and each of two sub-atmospheric air chambers 20*a*,20*a*′ at the same end of the roll.

Figure 12A:
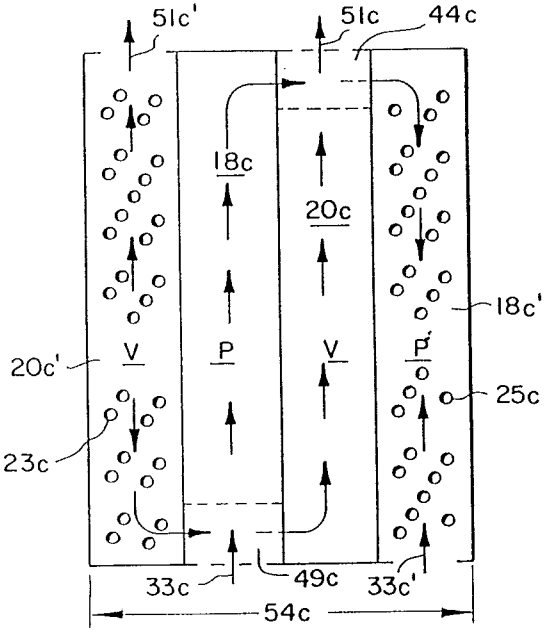
FIGS. 12 and 12*a* are end elevational and development views of the roll shaft (core body) and its circumference, respectively, and showing the application of super-atmospheric and sub-atmospheric air pressure P,V, respectively, to two of each of such chambers, two from both ends of the core body.
Figure 12:
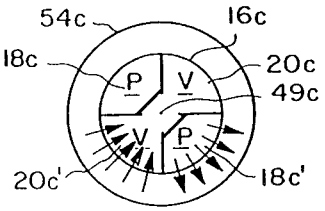

In FIG. 12, super-atmospheric air pressure is applied to each of two chambers 18*c*,18*c*′ at one end of the roll, and sub-atmospheric air pressure is applied to each of two chambers 20*c*,20*c*′ at the other end of the roll.

Figure 13A:
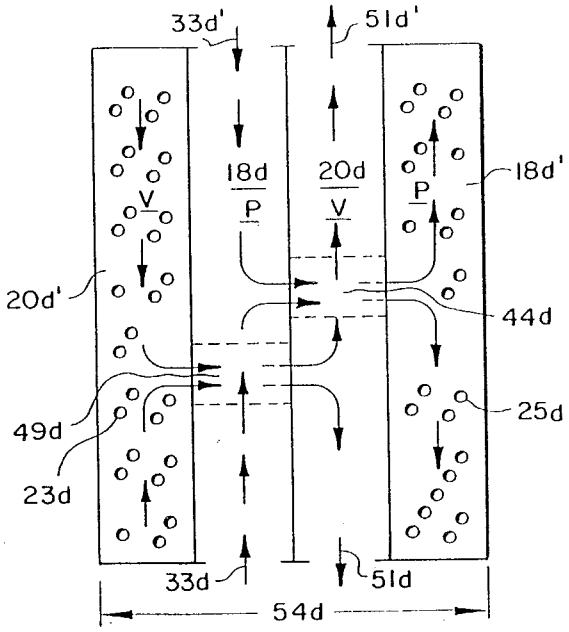
FIGS. 13 and 13*a* are end elevational and development views of the roll shaft (core body) and its circumference, respectively, and showing the application of super-atmospheric and sub-atmospheric air pressure P,V, respectively, to two of each of such chambers, two from both ends of the core body.
Figure 13:
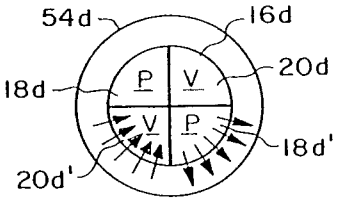

In FIGS. 13,13*a*, super-atmospheric air pressure is introduced into chambers 18*d*,18*d*′ from both ends of the roll, and sub-atmospheric air pressure is applied to chambers 20*d*,20*d*′ from both ends of the roll. An opening 44*d*,49*d* is located approximately in the center of the roll to permit fluid communication between each of the chambers 18*d*,18*d*′ and 20*d*,20*d*′, respectively, to distribute the super-atmospheric and sub-atmospheric pressure air as shown by the arrows 33*d*,33*d*′, 51*d*,51*d*′.

The operation of the rolls, which have their core bodies (shafts) shown in FIGS. 9–13, is essentially the same as that described above and in conjunction with the embodiment shown in FIGS. 4–8. The significant difference is that the super-atmospheric and sub-atmospheric air pressures are connected to one or two of the chambers 18,18′,20,20′ from either the same or opposite ends of the roll, as shown in figures and described above.

It is anticipated that variations in the structure can be made without departing from the spirit and scope of the appended claims which define the invention.

What is claimed is:

1. A roll for ventilating air in a pocket, such as the space intermediate the dryer rolls, fabric and paper web in a papermaking machine, comprising, in combination:

a stationary center shaft having an interior space, front and rear ends with journals at either end;

wall means in the center shaft forming a portion of the inner space into a plurality of longitudinally extending chambers, there being at least two vacuum chambers and at least two pressure chambers;

vacuum conduit means within at least one of the journals for establishing fluid communication between a source of sub-atmospheric pressure air and a vacuum chamber;

pressure conduit means within at least one of the journals for establishing fluid communication between a source of super-atmospheric pressure air and a pressure chamber;

a roll shell having perforations in its cylindrical surface, which perforations extend along an effective face length of its surface for permitting ventilating air to pass therethrough;

bearings at either end of the roll for rotatably supporting the roll shell about the center shaft;

first connection means linking at least two of the plurality of pressure chambers in fluid communication with one another;

second connection means linking at least two of the plurality of vacuum chambers in fluid communication with one another;

the wall means and first and second connection means arranged to alternate the vacuum and pressure chambers circumferentially about the center shaft;

seal means disposed between the center shaft and roll shell, and slidably engaging the inner surface of the roll shell, said seal means maintaining fluid separation between the vacuum and pressure chambers between the center shaft and roll shell;

distribution means within at least one vacuum chamber for receiving air from the pocket, and within at least one pressure chamber for distributing air into the pocket.

2. A roll for ventilating air in a pocket as set forth in claim 1, wherein:

the first connection means comprises a chamber linking adjacent ends of the first and second pressure chambers.

3. A roll for ventilating air in a pocket as set forth in claim 1, wherein:

the second connection means comprises an opening linking adjacent ends of the first and second vacuum chambers.

4. A roll for ventilating air in a pocket as set forth in claim 1, wherein:

the first connection means comprises a chamber linking the downstream end of a first pressure chamber with the upstream end of a second pressure chamber; and the second connection means comprises an opening linking the downstream end of a first vacuum chamber with the upstream end of a second vacuum chamber.

5. A roll for ventilating air in a pocket as set forth in claim 1, wherein:

the first and second connection means each comprise an opening linking two pressure and vacuum chambers, respectively, intermediate their ends.

6. A roll for ventilating air in a pocket as set forth in claim 4, wherein:

the distribution means comprises a plurality of openings in both the second vacuum and pressure chambers.

7. A roll for ventilating air in a pocket as set forth in claim 1, wherein:

the seal means comprises annular seal means between the center shaft and roll shell near either end of the effective face length, and longitudinal seal means extending between the annular seal means, said longitudinal seal means disposed between adjacent vacuum and pressure compartments.

8. A roll for ventilating air in a pocket as set forth in claim 1, wherein:

the pressure and vacuum conduit means are in the same end of the roll;

the first and second connection means link the pressure and vacuum chambers such that the direction of air flow in adjacent pressure and vacuum chambers is in opposite directions.

9. A roll for ventilating air in a pocket as set forth in claim 8, wherein:

the chambers having distribution means are adjacent one another.

10. A roll for ventilating air in a pocket as set forth in claim 9, wherein:

the chambers having distribution means are the most upstream ones of the linked vacuum chambers, and the most downstream ones of the linked pressure chambers.

11. A roll for ventilating air in a pocket as set forth in claim 8, wherein:

the center shaft contains two vacuum chambers and two pressure chambers which are alternately located circumferentially about the center shaft, the most upstream vacuum chamber having distribution means being adjacent the most downstream pressure chamber having distribution means.

12. A roll for ventilating air in a pocket as set forth in claim 1, wherein:

the vacuum and pressure conduit means are in the same journal and are each connected to a corresponding one of said vacuum and pressure chambers.

13. A roll for ventilating air in a pocket as set forth in claim 1, wherein:

the pressure and vacuum conduit means are in opposite ends of the roll.

14. A roll for ventilating air in a pocket as set forth in claim 1, wherein:

the pressure and vacuum conduit means each are in both ends of the roll.

15. A roll for ventilating air in a pocket, such as the space intermediate the dryer rolls, fabric and paper web in a papermaking machine, comprising, in combination:

a center shaft having an interior space and front and rear ends;

a journal at either end of the center shaft, at least one of the journals being hollow;

first wall means diametrically extending across the said at least one hollow journal and the interior space of the center shaft, said first wall means, or an extension thereof, dividing the said at least one hollow journal into vacuum and pressure conduits for connecting sources of sub-atmospheric pressure, and super-atmospheric pressure, air, respectively, with the interior space of the center shaft;

second wall means in the center shaft forming, with the first wall means and the interior of the center shaft, a portion of the interior space into a plurality of longitudinally extending chambers, there being at least two vacuum chambers and at least two pressure chambers;

a roll shell having perforations in its cylindrical surface, which perforations extend along an effective face length of its surface for permitting ventilating air to pass therethrough;

bearings at either end of the roll for rotatably supporting the roll shell on the journals about the center shaft;

first connection means linking at least two of the plurality of pressure chambers in fluid communication with one another;

second connection means linking at least two of the plurality of vacuum chambers in fluid communication with one another;

the first and second wall means within the center shaft, and the first and second connection means, arranged to alternate the vacuum and pressure chambers circumferentially about the center shaft;

seal means disposed between the center shaft and roll shell and slidably engaging the inner surface of the roll shell, said seal means maintaining fluid separation between the vacuum and pressure chambers between the center shaft and roll shell;

distribution means within at least the most upstream vacuum chamber for receiving air from the pocket, and within at least the most downstream pressure chamber for distributing air into the pocket.

16. A roll for ventilating air in a pocket as set forth in claim 15, wherein:

the downstream end of the pressure chamber linked with the pressure conduit is linked with the upstream end of the next pressure chamber;

the upstream end of the vacuum chamber linked with the vacuum conduit is linked with the downstream end of the next vacuum chamber.

* * * * *